US006475104B1

(12) United States Patent
Lutz et al.

(10) Patent No.: US 6,475,104 B1
(45) **Date of Patent: *Nov. 5, 2002**

(54) IMPREGNATED WOUND GOLF BALL AND METHODS OF FORMING SAME

(75) Inventors: Mitchell E. Lutz, Fairhaven, MA (US); Roman D. Halko, Mansfield, MA (US); Laurent Bissonnette, Portsmouth, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/497,503

(22) Filed: Feb. 4, 2000

Related U.S. Application Data

(63) Continuation-in-part of application No. 09/266,847, filed on Mar. 12, 1999, now Pat. No. 6,149,535.

(51) Int. Cl.[7] ..... A63B 37/06; A63B 37/00; A63B 37/08

(52) U.S. Cl. ..... 473/357; 473/351; 473/356; 473/354

(58) Field of Search ..... 473/351, 354, 473/356, 357, 359, 360, 361, 362, 366, 370, 371, 374, 376

(56) References Cited

U.S. PATENT DOCUMENTS

| | | | | |
|---|---|---|---|---|
| 972,313 A | | 10/1910 | Worthington | |
| 1,622,601 A | | 3/1927 | Miller | |
| 4,272,079 A | | 6/1981 | Nakade et al. | 273/225 |
| 4,473,229 A | | 9/1984 | Kloppenburg et al. | 273/225 |
| 5,006,297 A | | 4/1991 | Brown et al. | 264/234 |
| 5,334,673 A | | 8/1994 | Wu | 273/235 |
| 5,484,870 A | | 1/1996 | Wu | 528/28 |
| 5,685,785 A | | 11/1997 | Kakiuchi et al. | 473/354 |
| 5,733,428 A | | 3/1998 | Calabria et al. | 264/134 |
| 5,813,923 A | | 9/1998 | Cavallaro et al. | 473/373 |
| 5,993,968 A | | 11/1999 | Umezawa et al. | 428/407 |
| 6,030,296 A | * | 2/2000 | Morgan et al. | 473/361 |
| 6,142,885 A | * | 11/2000 | Umezawa et al. | 473/365 |

FOREIGN PATENT DOCUMENTS

| | | |
|---|---|---|
| DE | 1428816 | 4/1969 |
| GB | 1021424 | 3/1966 |
| GB | 1321269 | 6/1973 |
| GB | 1321270 | 6/1973 |

* cited by examiner

*Primary Examiner*—Paul T. Sewell
*Assistant Examiner*—Alvin A. Hunter, Jr.
(74) *Attorney, Agent, or Firm*—Swidler Berlin Shereff Friedman, LLP

(57) ABSTRACT

A wound golf ball that includes a wound core surrounded by a cover, wherein the wound layer is at least partially impregnated with a thermoplastic or thermoset material. The wound core is formed of a fluid-filled or solid center, and at least one wound layer surrounding the center.

23 Claims, 2 Drawing Sheets

IMPREGNATED WOUND GOLF BALL AND METHODS OF FORMING SAME

CROSS-REFERENCE TO RELATED APPLICATION

This application is a continuation-in-part of application Ser. No. 09/266,847 filed Mar. 12, 1999, now U.S. Pat. No. 6,149,535, the disclosure of which is incorporated herein by express reference thereto.

FIELD OF THE INVENTION

This invention relates generally to golf balls including a core having at least one wound layer and a cover disposed thereabout, and more particularly to wound golf balls having a wound core construction incorporating a solidified liquid material, such as a thermoplastic or thermoset polymer, therein.

BACKGROUND OF THE INVENTION

Conventional golf balls can be divided into two general types or groups: solid balls and wound balls. The difference in play characteristics resulting from these different types of constructions can be quite significant.

Solid balls with a two-piece construction are generally most popular with the average recreational golfer, because they provide a very durable ball while also providing maximum distance. Two piece solid balls are made with a single solid core, usually made of a crosslinked rubber, which is encased by a hard cover material. The combination of the core and cover materials, which are very rigid, provide a hard feel for the ball when it is struck with a club and provide a ball that is virtually indestructible by golfers. This combination of materials imparts a high initial velocity to the ball, which results in improved distance. In addition, due to this combination these balls have a relatively low spin rate which provides greater distance.

At the present time, however, the wound ball remains the preferred ball of more advanced players due to its spin and feel characteristics. Wound balls typically have either a solid rubber or fluid-filled center around which many yards of a tensioned elastic thread or yam are wrapped to form a wound core. The wound core is then typically covered with a durable cover material, such as a SURLYN® or a similar material, or a softer "performance" cover, such as balata or polyurethane. The cover material adheres to the wound core.

Typically, a single strand of thread is employed in forming the wound core. This thread can be wrapped at variable tension as disclosed in U.S. Pat. No. 4,783,078 issued to Giza. Some balls, however, have used two different threads of different dimensions to form the wound core. In this case, the inner most thread may be wound at a different tension and with a different pattern than the outer most thread. Furthermore, the outer most thread is generally wound in a more open pattern to form larger gaps between the thread to assure good amalgamation between the cover and the wound core.

The United States Golf Association (USGA), the organization that sets the rules of golf in the United States, has instituted a rule that prohibits the competitive use in any USGA sanctioned event of a golf ball that can achieve greater than an initial velocity of 76.2 meters per second (mis), or 250 ft/s, when tested in a standardized device operated by the USGA (referred to hereinafter as "the USGA test"). An allowed tolerance of 2 percent, however, permits manufacturers to produce golf balls that achieve an initial velocity of up to 77.7 m/s (255 ft/s).

Players generally seek a golf ball that delivers maximum distance, which requires a high initial velocity upon impact. Therefore, in an effort to meet the demands of the marketplace, manufacturers strive to produce golf balls with initial velocities no greater than that permitted by the USGA test. Manufacturers try to provide these balls with a range of different properties and characteristics, such as spin and compression.

To meet the needs of golfers having varying levels of skill, golf ball manufacturers are also concerned with varying the compression of the ball, which is a measurement of the deformation of a golf ball under a fixed load. A ball with a higher compression feels harder than a ball of lower compression. With initial velocities in the range of 245 to 255 ft/sec in the USGA test, wound golf balls generally have lower compression and spin characteristics that are preferred by better players. Whether wound or solid, all golf balls become generally more resilient (i.e., have higher initial velocities) as compression increases. Manufacturers of both wound and solid construction golf balls must balance the requirement of higher initial velocity from higher compression with the desire for a softer feel from lower compression.

Wound balls typically enable a skilled golfer to have more control over the ball's flight and final position than many non-wound balls. Particularly with approach shots into the green, the typically higher spin rate of soft covered wound balls enables the golfer to stop the ball very near its landing position. Soft covered wound balls with their lower compression, however, tend to exhibit a lower initial velocity than hard covered solid balls. This characteristic, in combination with a higher spin rate than solid balls, means wound balls generally display shorter distance than hard covered solid balls. The advantages of wound constructions over solid ones, however, are more related to spin and controllability than distance.

A softer feel is the result of a lower compression, but feel is also affected by cover hardness and thickness. In wound constructions, a thinner cover will have a softer feel, so manufacturers often strive to produce balls with the thinnest possible covers. The packing density of the windings affects the thickness of the cover, but other factors related to the cover will also affect this thickness.

Some manufacturers dip wound cores in a latex material. A light application of latex is applied to wound cores to improve cover quality or to ensure that cores or wound layers do not unravel. For example, in balls whose covers are formed in a liquid casting process, such as U.S. Pat. Nos. 5,006,297 and 5,733,428, the conventional wound cores are submerged to obtain a light application of latex material prior to covering. A "light application" of latex material is obtained with a particular combination of percentage solids applied using a particular submersion time. For a light latex application, the greater the percentage of solids, the shorter the submersion time, and when the percentage of solids decreases the submersion time can increase. For example, a light latex application can be accomplished using a latex of about 5% solids applied using a submersion time of less than eight seconds, as disclosed in U.S. Pat. No. 5,006,297. Also, a light latex application as disclosed in U.S. Pat. No. 5,733,428 is accomplished using a latex of about 30%–60% solids that is applied using a submersion time of less than eight seconds. A "heavier" latex application on the outer surface of the wound core reduces the amalgamation of the cover with the windings. Thus, an excessive application of latex on the outer surface of the wound core interferes with core-cover adhesion decreasing cover durability.

Another purpose of this light latex application is to seal in any air trapped between the innermost threads. If the air is not trapped, it can rise to the surface of the cover during the covering process and form air bubbles. Since these air bubbles are visible through the cover, they are undesirable imperfections in the golf ball and may result in reduced durability. As discussed above, however, a heavier application of the latex material can be problematic since it may, for example, decrease adhesion of the cover material to the wound core.

Additional references disclose other variations of a rubber or latex used with a thread layer, such as U.S. Pat. No. 4,272,079 that discloses a wound ball including a single wound thread layer over a center forming a wound core. This wound core is covered with a latex-containing ionomer resin that coats the surface of the thread layer. A cover is formed on the core. Since the latex and cover are formed with ionomer resin, an adhesive bond is formed therebetween. The ionomer latex improves the adhesion between the cover and the wound layer.

U.K. Patent No. 1,021,424 discloses a wound ball that includes a center and a rubber tape layer wound on the center. The ball further includes a first layer of rubber thread wound on the tape layer. This forms a wound core, which is immersed in a natural rubber latex that fills the interstices between the rubber threads to form a thread portion and a barrier surface on top of the thread portion. Then a second layer of thread is wound thereon. The cover is applied to the second layer of thread so that the cover penetrates the second layer of thread to the barrier surface. The barrier surface acts as a depth control for preventing the penetration of the cover material to a substantial degree inwardly towards the center. Thus, the latex material and the cover material are in contact, and the latex material effectively behaves as an extension of the cover into the thread layer.

U.S. Pat. No. 972,313 discloses a wound golf ball having a core of small rubber fragments compressed into the desired form by a rubber thread wound thereon. A layer of weighted, unvulcanized sheet rubber is disposed thereon, which includes a suitable heavy mineral powder such as red oxide of mercury. Then a second, separate layer of rubber thread is wound about the unvulcanized rubber sheet and a cover is disposed thereabout to form a golf ball.

U.K. Patent No. 1,321,269 discloses a golf ball having a spherical wound core member, a contiguous coating or thin layer of coalesced non-tacky polyurethane latex disposed about the core member, and a cover disposed about the latex layer. The latex layer is disclosed to advantageously protect the wound threads from breakage when the hot liquid cover material is applied to form the cover.

U.K. Patent No. 1,321,270 discloses a golf ball having a wound core covered by a thin plastic layer, preferably a liquid thermosetting plastic, and a cover. The thin plastic layer, or skin, penetrates the interstices of the outer thread winding of the wound layer and is on the order of 1 mil in thickness. The ball is prepared by preferably dipping a wound core as described in the preceding patent and placing the dipped, wound core in a mold, then filling the mold with a liquid curable plastics material, which is partially cured over the wound core without damaging the core. The partially cured preform is then placed in a second mold and a liquid curable plastics material is used to fill, e.g., by injection, the second mold and is partially cured to form the remainder of the cover.

Golf ball manufacturers are continually searching for new ways in which to provide wound golf balls that deliver the maximum performance for golfers. It would be advantageous to provide such a wound golf ball having improved playing characteristics.

SUMMARY OF THE INVENTION

The invention encompasses a golf ball including a center, an impregnated wound layer including a tensioned thread surrounding the center and at least one impregnation material disposed within the wound thread and having a penetration thickness greater than about 0.06 inches, and a cover including at least one layer surrounding the wound layer, wherein the thread is polymeric or glass. In another embodiment, the golf ball encompasses at least one impregnation material disposed within the wound thread and having a penetration thickness of at least about 5 percent of the thickness of the wound thread, wherein the thread is polymeric or glass.

In one embodiment, the center includes a fluid and a shell material to contain the fluid therein. In another embodiment, the wound layer has an inner edge nearer the center and an outer edge further from the center and the impregnation material is disposed adjacent the outer edge of the wound layer. In another embodiment, the impregnation material has a thickness of at least about 10 percent of the thickness of the wound thread. In another preferred embodiment, the impregnation material has a thickness of at least about 25 percent of the thickness of the wound thread. In another embodiment, the impregnation material has a thickness of at least about 50 percent of the thickness of the wound thread. In a preferred embodiment, the impregnation material penetrates substantially the entire thickness of the wound thread. In a different embodiment, which may be alternative or additional, the impregnation material has a thickness of at least about 0.1 inches, preferably with the material penetrating through at least about 10 percent of the thickness of the wound thread.

In another embodiment, the impregnation material includes materials with yield strains greater than about 10 percent. In a preferred embodiment, the yield strains are greater than about 20 percent. In a preferred embodiment, the impregnation material includes a thermoset or thermoplastic material, or a precursor thereof. In a more preferred embodiment, the impregnation material is selected from the group of vinyl resins, polyolefin homo- or co-polymers; polyurethanes; polyureas; polyamides; acrylic resins; thermoplastic rubbers; polyphenylene oxide resins; thermoplastic polyesters; solvent or suspension based latexes of polyisoprene or polybutadiene; reactive resins; and blends or mixtures thereof.

In another embodiment, the impregnated wound layer further includes at least one filler present in a sufficient amount to adjust the density of the impregnated wound layer.

In another embodiment, the golf ball includes at least one intermediate layer disposed between the impregnated wound layer and the cover. In another embodiment, the intermediate layer is adjacent to the impregnated wound layer, comprises the at least one impregnation material, and is continuous with the at least one impregnation material in the wound layer.

The invention also encompasses a method for forming a golf ball which includes forming a center, providing an impregnation material in a liquid state to a portion of a tensioned, wound thread formed of a material comprising a polymer or glass, curing the impregnation material so as to form an impregnated wound center having a substantially solid matrix material, and forming a cover on the impregnated wound center to form a golf ball.

In a preferred embodiment, the tensioned thread is wound around the center before providing the impregnation material so as to form a wound center having a wound layer disposed about the center. In a first preferred embodiment, the providing includes submerging the wound center in a liquid impregnation material, sealing the wound center and the liquid impregnation material in a cavity, and reducing the pressure sufficiently below atmospheric pressure in the sealed cavity to facilitate penetration of the impregnation material into the wound layer. In a second preferred embodiment, the providing impregnation material step includes placing the wound center in a sealed cavity, reducing the pressure in the cavity sufficiently below atmospheric pressure to facilitate penetration of the impregnation material into the wound layer, and injecting a sufficient amount of liquid impregnation material into the sealed cavity so as to penetrate and impregnate the wound layer to a desired depth. In a preferred embodiment, the pressure is reduced below about 1 Torr. In a more preferred embodiment, the pressure is reduced below about 0.01 Torr. In a third preferred embodiment, the providing step includes submerging the wound center in a liquid impregnation material, sealing the wound center and the liquid impregnation material in a cavity, increasing the pressure in the cavity sufficiently above atmospheric pressure to force the impregnation material into the voids between the wound thread to a desired penetration thickness, and then reducing the pressure to facilitate gas from the voids to escape from the wound thread. In a preferred embodiment, the increased pressure is from 1 atm to about 200 atm.

In another embodiment, the providing includes contacting a portion of the tensioned thread with a liquid impregnation material, and subsequently winding the thread around the center to form a wound center. In a preferred embodiment, the contacting process includes immersing the thread in a bath of liquid impregnation material.

In another embodiment, particularly where the impregnation material is solid at ambient temperature, the impregnation material is heated so as to remain in a liquid state before providing to the thread.

In another embodiment, the cover forming step includes compression molding, injection molding, or casting a cover material onto the impregnated wound center. In a preferred embodiment, the cover forming step is conducted by casting.

DEFINITIONS

Figure 1:
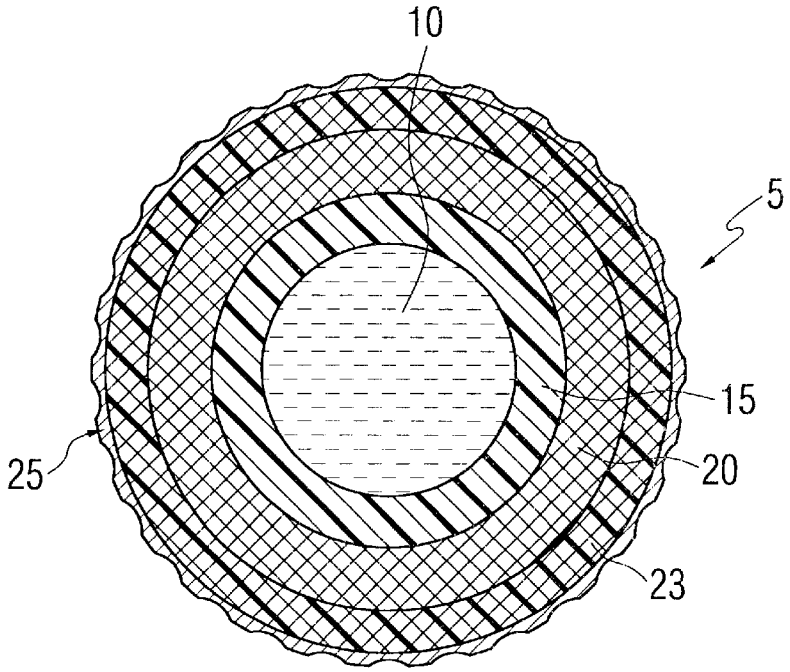
FIG. 1 is a cross-sectional view of one embodiment of a golf ball according to the present invention.

The term "about," as used herein, should be understood to refer to both numbers in a range of numbers.

As used herein, the term "Atti compression" is defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. When the Atti Gauge is used to measure cores having a diameter of less than 1.680 inches, it should be understood that a metallic or other suitable shim is used to make the measured object 1.680 inches in diameter. However, when referring to the compression of a core, it is preferred to use a compressive load measurement. The term "compressive load" is defined as the normalized load in pounds for a 10.8-percent diametrical deflection for a spherical object having a diameter of 1.58 inches.

The term "fluid," as used herein, includes gases, liquids, and gels.

DETAILED DESCRIPTION OF THE INVENTION

Golf balls having impregnated wound layers that are separate from or identical to the material used in an adjacent layer, as well as method of preparing the same, have now been discovered. The impregnated wound layer(s) include a matrix material to fill void space between the winding material, which is typically a tensioned material. The impregnated wound layer(s) can help provide a golf ball core and resultant golf ball with one or more of the following advantageous benefits: improved and/or adjusted weight distribution and inertia in the golf ball, improved core symmetry, improved processability and handling of cores, improved velocity of the golf ball, or decreased compression in the core.

The golf ball includes a center about which at least one wound layer is disposed. The center may be fluid-filled or solid, but is more often fluid-filled. In either case, the center is prepared using any material available to those of ordinary skill in the art. Examples of solid center materials include solid rubber, solid thermoplastic material, cork, wood, metal, or any combination thereof. Examples of fluid-filled center materials for the shell that contains the fluid include a fluid of any composition and viscosity surrounded by a shell made of a plastic, rubber, metal, or the like.

The wound layer disposed about the center has an inner edge adjacent the center and an outer edge adjacent the cover or optional intermediate layers. The tension used in winding the thread material of the wound layer may be selected as desired to provide beneficial playing characteristics to the final golf ball. Thread with different material properties, dimensions, cross-sectional shapes, and methods of manufacturing the thread may be used for each wound layer present in the ball. The material properties of the thread that can be varied include, for example, ultimate or maximum elongation and tensile modulus. For example, the thread may be formed from fiber, including glass, carbon, or polymeric material, such as HYTREL, a polyetherester commercially available from E. I. DuPont de Nemours of Wilmington Del. Preferred threads are elastomeric, while graphite thread tends to be less preferred than other available thread types due to the difficulty in placing such threads under tension when being wound about a center.

Any process known to those of ordinary skill in the art may be employed to produce thread materials for use in the wound layer, including, for example, slitting rubber sheets prepared by calendering solid rubbers, slitting rubber sheets prepared from cast latex rubber, melt spinning, wet spinning, dry spinning, polymerization spinning, or extruding thread from polymeric material. In addition, the winding patterns used for the wound layer can be varied as is known by those of ordinary skill in the art. Although one or more threads may be combined to begin forming the wound layer, it is preferred to use only a single continuous thread to which the impregnation material is provided to form the wound layer. In sum, any type of wound layer available to those of ordinary skill in the art may be included in the golf ball of the present invention.

The wound layer and the center together form the core of the golf ball. An impregnation material is then applied to the core as discussed herein. As used herein, "liquid material" or "impregnation material" mean the material used to impregnate the wound core and can be any material, or combination thereof, that has a liquid state and solidifies to form a flexible film. The impregnation material typically has a yield strain greater than about 10 percent, preferably greater than about 20 percent. This material may include any polymeric material, such as thermoplastic or thermoset polymer, or any precursor or combination thereof, available to those of ordinary skill in the art. For example, suitable impregnation materials include ionic copolymers of ethylene and an unsaturated monocarboxylic acid, which are commercially available under the trademark SURLYN of E. I. DuPont de Nemours & Co., of Wilmington, Del., or IOTEK or ESCOR, which are commercially available from Exxon Corp. These are copolymers or terpolymers of ethylene and methacrylic acid or acrylic acid partially neutralized with salts of zinc, sodium, lithium, magnesium, potassium, calcium, manganese, nickel or the like, in which the salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The impregnation material can likewise include one or more homopolymeric or copolymeric materials, such as:

(1) Vinyl resins, such as those formed by the polymerization of vinyl chloride, or by the copolymerization of vinyl chloride with vinyl acetate, acrylic esters or vinylidene chloride;

(2) Polyolefins, such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using a single-site catalyst;

(3) Polyurethanes, such as those prepared from polyols and diisocyanates or polyisocyanates and those disclosed in U. S. Pat. No. 5,334,673;

(4) Polyureas, such as those disclosed in U.S. Pat. No. 5,484,870;

(5) Polyamides, such as poly(hexamethylene adipamide) and others prepared from diamines and dibasic acids, as well as those from amino acids such as poly (caprolactam), and blends of polyamides with SURLYN, polyethylene, ethylene copolymers, ethylpropylene-non-conjugated diene terpolymer, and the like;

(6) Acrylic resins and blends of these resins with poly vinyl chloride, elastomers, and the like;

(7) Thermoplastics, such as urethanes; olefinic thermoplastic rubbers, such as blends of polyolefins with ethylene-propylene-non-conjugated diene terpolymer; block copolymers of styrene and butadiene, isoprene or ethylene-butylene rubber; or copoly(ether-amide), such as PEBAX, sold by ELF Atochem of Philadelphia, Pa.;

(8) Polyphenylene oxide resins or blends of polyphenylene oxide with high impact polystyrene as sold under the trademark NORYL by General Electric Company of Pittsfield, Mass.;

(9) Thermoplastic polyesters, such as polyethylene terephthalate, polybutylene terephthalate, polyethylene terephthalate/glycol modified and elastomers sold under the trademarks HYTREL by E. I. DuPont de Nemours & Co. of Wilmington, Del., and LOMOD by General Electric Company of Pittsfield, Mass.;

(10) Blends and alloys, including polycarbonate with acrylonitrile butadiene styrene, polybutylene terephthalate, polyethylene terephthalate, styrene maleic anhydride, polyethylene, elastomers, and the like, and polyvinyl chloride with acrylonitrile butadiene styrene or ethylene vinyl acetate or other elastomers; and

(11) Blends of thermoplastic rubbers with polyethylene, propylene, polyacetal, nylon, polyesters, cellulose esters, and the like.

(12) Solvent and suspension based latexes of polyisoprene or polybutadiene.

(13) Reactive resins, such as expoxies, polyesters, and polyamides.

Preferably, the impregnation material includes polymers, such as ethylene, propylene, butene-1 or hexane-1 based homopolymers or copolymers including functional monomers, such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly(tetrafluoroethylene) and their copolymers including functional comonomers, and blends thereof. Suitable compositions also include a polyether or polyester thermoplastic urethane, a thermoset polyurethane, a low modulus ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. More preferably, in a low spin rate embodiment designed for maximum distance, the acrylic or methacrylic acid is present in about 15 to 35 weight percent, making the ionomer a high modulus ionomer. In a high spin embodiment, the compositions can include an ionomer where an acid is present in about 10 to 15 weight percent and includes a softening comonomer. The impregnation material is preferably different from the predominant material used to form the tensioned winding, or thread, used to form the wound layer.

Fillers may be used to adjust the density, elastic modulus, mold release, and/or melt flow index of any layer of the golf ball, although preferably fillers are used to adjust the density of the impregnated wound layer. A density adjusting filler may be used to control the moment of inertia, and thus the initial spin rate of the ball and spin decay. For example, fillers may be present in an amount from 0 up to about 200 phr based on 100 phr of the impregnation material. A density adjusting filler according to the invention preferably is a filler that has a specific gravity of at least about 0.05 and more preferably at least about 0.5 higher or lower than the specific gravity of the impregnation material. Particularly preferred density adjusting fillers have specific gravities that are higher than the specific gravity of the resin composition by about 0.2 or more, more preferably by about 2 or more. The density-adjusting fillers for use in the invention preferably have a specific gravity in the range of about 0.6 to 20. These density-adjusting fillers may also incidentally modify the elastic modulus or mold release properties of the material to which they are added.

Fillers are typically polymeric or mineral particles. The filler preferably is selected from the group consisting of precipitated hydrated silica; clay; talc; asbestos; glass fibers; aramid fibers; mica; calcium metasilicate; barium sulfate; zinc sulfide; lithopone; silicates; silicon carbide; diatomaceous earth; polyvinyl chloride; carbonates such as calcium carbonate and magnesium carbonate; metals such as titanium, tungsten, aluminum, bismuth, nickel, molybdenum, iron, lead, copper, boron, cobalt, beryllium, zinc, and tin; metal alloys such as steel, brass, bronze, boron carbide whiskers, and tungsten carbide whiskers; metal oxides such as zinc oxide, iron oxide, aluminum oxide, titanium oxide, magnesium oxide, and zirconium oxide; particulate carbonaceous materials such as graphite, carbon black, cotton flock, natural bitumen, cellulose flock, and leather fiber; micro balloons such as glass and ceramic; fly ash; and combinations thereof.

For example, using a density-adjusting filler having a higher density than the impregnation material, golf balls can be prepared according to the present invention having a high density wound layer having higher resilience than conventional wound layers. Using a high density liquid material can decrease the density requirement of the center of the ball about which the impregnation material is disposed. This consequently adjusts the moment of inertia.

Preferably, the impregnation material will dry to a reasonably tack-free film or a film that can be rendered tack-free by exposure to beat or radiation. An important consideration is the ability of the impregnation material to deposit a film that penetrates the gaps between the wound thread and effectively forms a distinct portion within the wound layer to fill at least a portion of the voids within the wound layer. Those of ordinary skill in the art will be readily able to determine a suitable curing time for the impregnation material. A preferred curing time, depending upon the specific material, is less than about 2 hours, more preferably less than about 10 minutes.

The impregnation material is thus used to bind the thread in the wound layer, and has a thickness in the wound layer of at least two windings, preferably a thickness of at least about 5 percent of the wound layer, and more preferably a thickness of at least about 10 percent of the wound layer. In various embodiments, the impregnation material may also penetrate through a thickness of greater than about 50 percent of the wound layer, greater than about 75 percent of the wound layer, and through substantially the entire wound layer. In another embodiment, the impregnation penetrates the wound layer to a thickness of at least about 0.06 inches. In another embodiment, the penetration thickness is at least about 0.1 inches, while in yet another embodiment the penetration thickness is at least about 0.12 inches. The impregnation material may be disposed anywhere in the wound layer, but is preferably adjacent to the inner or outer edge of the wound layer, and more preferably is adjacent the outer edge of the wound layer so as to penetrate from the outer edge inward toward the center of the golf ball.

The golf ball may include one or more intermediate layers disposed about the wound, impregnated core using any suitable material available to those of ordinary skill in the art. In one embodiment, an intermediate layer disposed adjacent the wound layer includes the same impregnation material. In another embodiment, this adjacent intermediate layer includes a different material from that used to impregnate the winding. In either embodiment, this adjacent intermediate layer may be continuous with the wound layer and impregnation material or it may be a separate layer.

A cover is then disposed about the wound core and the optional intermediate layer(s) using any suitable material and any suitable method available to those of ordinary skill in the art. For example, suitable cover materials include one or more of those materials described herein for the impregnation material. Particularly suitable cover materials include trans-polyisoprene, ionomer resin, polyurethane, or a combination thereof. The cover may be a construction of one or more layers, but is typically either one or two layers. Suitable methods include, for example, compression molding, injection molding, or casting.

Any size golf ball may be formed according to the invention, although the golf ball preferably meets USGA standards of size and weight. For example, the final golf ball should typically have an outer diameter from about 1.67 to 1.72 inches and have the following internal dimensions. The center will typically have a diameter from about 0.5 inches to 1.6 inches, the wound layer disposed about the center will typically have a diameter less than about 1.66 inches. The wound layer of winding and impregnation material itself will typically have a thickness from about 0.05 inches to 0.6 inches.

One embodiment of the golf ball of the present invention is illustrated by FIG. 1. The golf ball 5 depicted in FIG. 1 has a fluid-filled center of a fluid 10 with a shell 15 disposed so as to contain the fluid 10. Alternatively, the fluid-filled center of fluid and shell can be a solid center of one or more layers (not depicted). A wound layer of a tensioned thread 20 is disposed about the fluid-filled center and an impregnation material 23 has been impregnated into the wound layer so as to penetrate some of the tensioned thread 20. A cover 25 having a plurality of dimples is disposed thereabout.

Figure 2:
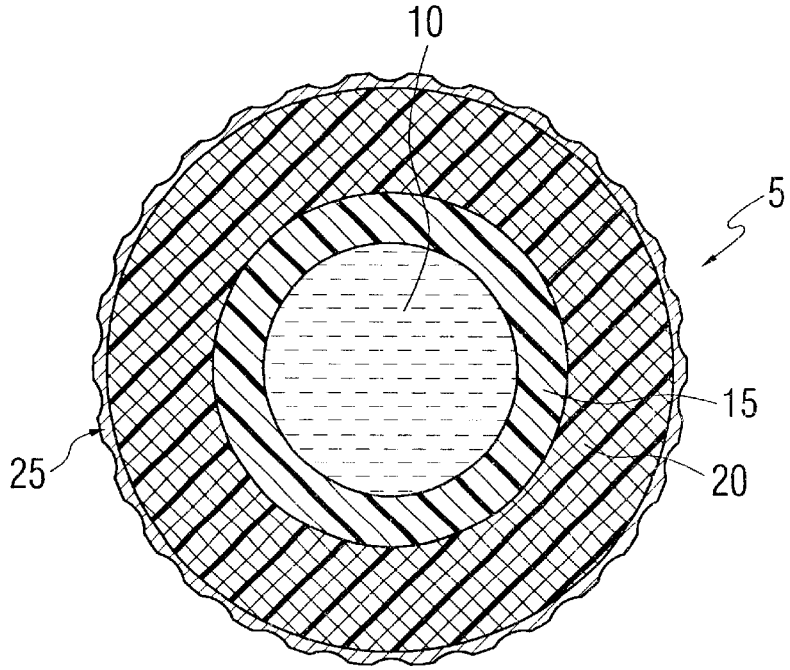
FIG. 2 is a cross-sectional view of another embodiment of a golf ball according to the present invention.

Another embodiment of the golf ball of the present invention is illustrated by FIG. 2. The golf ball 5 depicted in FIG. 2 has a fluid-filled center of a fluid 10 with a shell 15 disposed so as to contain the fluid 10. As in FIG. 1, the fluid 10 and shell 15 may be replaced by a solid center (not depicted) of one or more layers. A wound layer 20 of a tensioned material is disposed about the center. In this embodiment, an impregnation material has also been disposed to penetrate into the voids of the tensioned material, such that the impregnation material penetrates substantially the entire wound layer 20. A cover 25 having a plurality of dimples has been disposed about the wound layer 20.

Another embodiment, which is not depicted, includes the embodiment of FIG. 2 with at least one intermediate layer disposed between the wound layer and the cover. In one preferred embodiment, an intermediate layer adjacent to the wound layer includes the same impregnation material used to penetrate a portion of the wound layer. In another preferred embodiment, the impregnation material in the intermediate layer adjacent to the wound layer is continuous with the impregnation material that penetrates into the thread of the wound layer. A completely different material than the impregnation material could, of course, alternatively be used in forming the intermediate layer disposed over the impregnated wound layer. Any suitable material available to those of ordinary skill in the art may be used for this different material.

Figure 3:
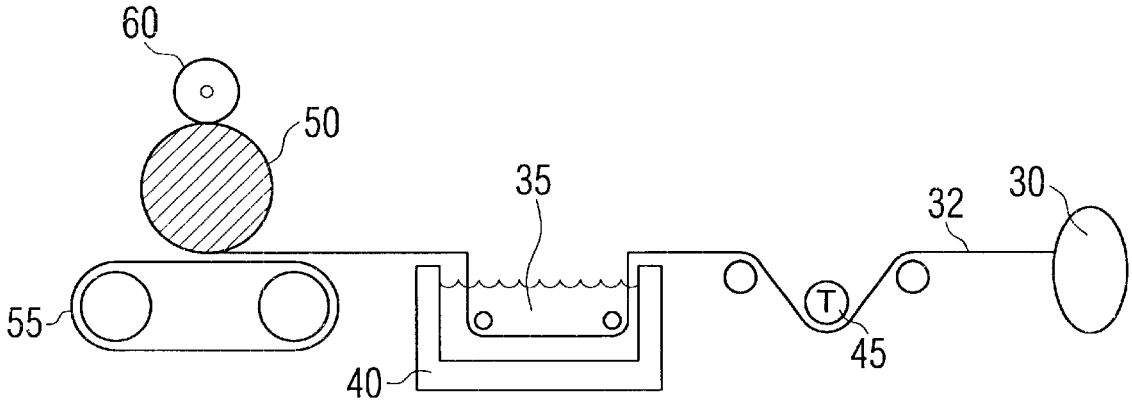
FIG. 3 is a schematic view of the wet winding embodiment of a golf ball according to the present invention.

FIG. 3 is a schematic view of the wet winding embodiment of a golf ball according to the present invention. In this embodiment, the thread 32 is provided from a thread supply 30 and contacted with the liquid impregnation material 35, e.g., by immersion in a bath or reservoir 40. The thread 32 is tensioned, e.g., by a magnetic tension control apparatus 45, either before (depicted) or after contact with the liquid impregnation material 35. After contact and tensioning, the thread is applied to a golf ball center 50, for example by means of a conveyor belt 55 and support roller 60, and cured to form an impregnated wound center.

The invention also includes methods to form a golf ball so as to have the impregnation material penetrate into the wound layer. In its broadest form, the method for disposing the impregnation material into the wound layer is accomplished by providing impregnation material adjacent the tensioned material of the wound layer so as to remove some air and bind the wound thread in the wound layer, followed by a drying or curing process to at least substantially solidify the impregnation material.

In one embodiment, the impregnation material is applied to the tensioned material, or thread, before the thread is applied to the center. Preferably, a portion of the thread is drawn from a supply portion through a bath of liquid impregnation material, which coats the thread. The tensioned thread and impregnation material are then applied together to the center. The portion of thread drawn through the bath is determined by the final desired location of the impregnation material in the wound layer. For example, if the impregnation material is desired on the outer edge of the wound layer, a certain terminal portion of the thread would have the impregnation material applied thereto. This "wet winding embodiment" is required if the impregnation material is desired anywhere other than adjacent to the outer edge of the wound layer. The bath may be heated to a sufficient temperature if required to maintain the impregnation material in a liquid state for application to the thread. Moreover, the wound center may be subjected to a conventional curing process if desired to crosslink thermoset-type impregnation materials.

In another embodiment, referred to as the "vacuum embodiment," the thread is already wound on the center to form a wound center, which is submerged in an impregnation material having a liquid state. As a result, the liquid impregnation material at least partially impregnates the wound layer to a predetermined depth. The material is permitted to dry and forms a flexible film. During immersion, as the liquid material moves inward into the wound layer, it replaces a portion of the air trapped between the wound thread in that portion.

There are two embodiments of the "vacuum embodiment." The vacuum embodiment is generally preferred over the bath embodiment for providing impregnation material to the wound layer. The first and preferred of the two vacuum embodiments uses reaction injection molding to inject impregnation material into the voids in the wound layer. Reaction injection molding in the context of this application is a process where typically 2 or more mixed liquid components are injected into a cavity containing a golf ball core having a wound layer, thereby permitting the liquid components to chemically react to create an impregnation material. A vacuum is pulled on the cavity during this process before the liquid components are injected therein. In the second vacuum embodiment, the wound core is merely submerged in a bath before a vacuum is applied. In each vacuum embodiment above, the vacuum is typically below atmospheric pressure, preferably below about 1 Torr, and more preferably below about 0.01 Torr. A stronger vacuum, i.e., a lower pressure, will typically result in a deeper penetration of the impregnation material into the wound layer. Moreover, the amount of air displaced by the vacuum relates to the amount of impregnation material entering the wound layer such that the depth of impregnation can be readily regulated. The vacuum advantageously facilitates removal of air or other gases trapped in the voids of the wound layer. The vacuum is subsequently released to let the liquid impregnation material flow into the wound layer. For each embodiment, the wound center having wet, impregnation material therein is removed from the liquid polymer or the apparatus. The wet, wound core is dried or cured using any conventional technique available to one of ordinary skill in the art to facilitate solidification of the liquid impregnation material into a substantially solid, and preferably entirely solid, state to form a golf ball core. The cover is then applied using any suitable materials and methods as described herein and available to those of ordinary skill in the art.

Yet another embodiment, similar to the second vacuum embodiment but wherein the pressure is increased sufficiently above atmospheric pressure, may alternatively be used to provide the impregnation material to the wound thread. The pressure will preferably be increased to a pressure from above atmospheric to about 200 atm, as greater pressures may have a tendency to deform or otherwise damage the wound core. This embodiment permits the impregnation material to be forced into a portion of the voids disposed between the wound thread.

EXAMPLES

These and other aspects of the present invention may be more fully understood with reference to the following examples, which are merely illustrative of preferred embodiments of the present invention and are not to be construed as limiting the invention.

Example 1

An Impregnated Wound Golf Ball Prepared According to the Invention

A fluid-filled center was prepared by using PEBAX having a specific gravity of 1.6 to surround the water. The PEBAX shell had a thickness of 0.1 inches and a diameter of 1.13 inches. A polyisoprene thread rubber, commercially available from Fulflex of Middletown, R.I., was then wound about the fluid-filled center.

An impregnation material was prepared having 126.2 parts of VIBRATHANE B-979, commercially available from Uniroyal Chemical Co., Inc. of Middlebury, Conn., and 73.8 parts POLY THF 650, commercially available from BASF Corporation of Parsippany, N.J. 1.6 g of the thus formed impregnation material was then applied to the center by the vacuum immersion method according to the invention using a pressure below approximately 10 Torr and cured for about 2 hours at 160° F., resulting in a golf ball core with an impregnated center having a compression of 71 and a weight of about 36.9 g. A conventional cover of a blend based on lithium and sodium ionomers having about 15% acid comonomer was applied to form a golf ball having a compression of 83 and a velocity of 254.85 ft/s.

Comparative Example 2

A Non-Impregnated Wound Golf Ball Compared to an Impregnated Wound Golf Ball Prepared According to the Invention A water-filled center was prepared by using PEBAX having a specific gravity of 1.6 to surround the water. The PEBAX shell had a thickness of 0.1 inches and a diameter of 1.13 inches. 32.2 g of a tensioned polyisoprene thread, commercially available from Fulflex, was wound onto the center to form a wound center having a diameter of 1.58 inches.

An impregnation material was prepared having 2.35 parts of ADIPRENE LFP X950A having 5.73 parts isocyanate and 1.0 parts POLY THF 650. The ADIPRENE LFP X950A is a prepolymer of polyparaphenylene diisocyanate ("PPDI") and polytetramethyleneetherglycol ("PTMEG") polyol, commercially available from Uniroyal Chemical Co., Inc., and the POLY THF 650, commercially available from BASF Corporation. The impregnation material thus produced has a shore D hardness of approximately 18.

2.2 g of impregnation material was applied to the center by pulling a vacuum of about 10 Torr for 5 minutes. The elastomer was inserted into a mold, clamped, cured for two hours at 160° F., and cooled to room temperature, which resulted in a golf ball core with an impregnated center having a compression of about 65, a diameter of 1.56 inches, and a coefficient of restitution of 0.833 at 125 ft/s impact. The impregnation material penetrated approximately 50 percent of the thickness of the wound layer from the outer edge of the wound layer. A commercially available urethane cover material, such as MDI and PTMEG prepolymers cured with VERSALINK P-250 diamine (available from Air Products) was applied to form a golf ball. This impregnated, wound golf ball is compared to a non-impregnated, wound golf ball that is otherwise identical:

| | Control Golf Ball | Golf Ball of Invention |
|---|---|---|
| Compression | 90 | 71 |
| Initial Velocity (ft/s) | 251.1 | 252.1 |

Twelve conventional balls and twelve balls according to the invention were prepared. The final golf balls prepared according to the invention was approximately 20 compression points lower than the control balls, while advantageously having a greater initial velocity. Thus, it is possible to modify compression and other characteristics, such as the coefficient of restitution, to achieve desired playing characteristics in golf balls with the present invention.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments which would come within the spirit and scope of the present invention.

What is claimed is:

1. A golf ball comprising:

a center;

an impregnated wound layer comprising a tensioned thread surrounding the center and at least one impregnation material disposed within the wound thread and having a penetration thickness greater than about 0.06 inches; and a cover comprising at least one layer surrounding the wound layer, wherein the thread is polymeric or glass.

2. The golf ball of claim 1, wherein the center comprises a fluid and a shell material that contains the fluid therein.

3. The golf ball of claim 1, wherein the wound layer has an inner edge nearer the center and an outer edge further from the center and wherein the impregnation material is disposed adjacent the outer edge of the wound layer.

4. The golf ball of claim 1, wherein the impregnation material has a penetration thickness that is at least about 25 percent of the wound thread.

5. The golf ball of claim 1, wherein the impregnation material has a penetration thickness that is greater than about 0.1 inches and at least about 10 percent of the thickness of the wound thread.

6. The golf ball of claim 1, wherein the impregnation material penetrates substantially the entire thickness of the wound thread.

7. The golf ball of claim 1, wherein the impregnation material is selected from the group consisting of a thermoset material, a thermoplastic material, and precursors and mixtures thereof.

8. The golf ball of claim 7, wherein the impregnation material is selected from the group consisting of vinyl resins; ionic copolymers of ethylene and an unsaturated monocarboxylic acid, polyolefin homo-polymers; polyolefin co-polymers; polyurethanes; polyureas; polyamides; acrylic resins; thermoplastic rubbers; polyphenylene oxide resins; thermoplastic polyesters; solvent based latexes of polyisoprene; solvent based latexes of polybutadiene; suspension based latexes of polyisoprene; suspension based latexes of polybutadiene; reactive resins; and blends and mixtures thereof.

9. The golf ball of claim 1, wherein the impregnated wound layer further comprises at least one filler present in a sufficient amount to adjust the density of the impregnated wound layer.

10. The golf ball of claim 1, further comprising at least one intermediate layer disposed between the impregnated wound layer and the cover.

11. The golf ball of claim 10, wherein the intermediate layer adjacent the impregnated wound layer comprises the at least one impregnation material disposed in the wound layer and is continuous with the at least one impregnation material therein.

12. A golf ball comprising:

a center;

an impregnated wound layer comprising a tensioned thread surrounding the center and at least one impregnation material disposed within the wound thread and having a penetration thickness greater than about 5 percent of the wound thread; and a cover comprising at least one layer surrounding the wound layer, wherein the tensioned thread comprises a polymeric material or glass.

13. The golf ball of claim 12, wherein the center comprises a fluid and a shell material that contains the fluid therein.

14. The golf ball of claim 12, wherein the wound layer has an inner edge nearer the center and an outer edge further from the center and wherein the impregnation material is disposed adjacent the outer edge of the wound layer.

15. The golf ball of claim 12, wherein the impregnation material has a penetration thickness that is at least about 10 percent of the thickness of the wound thread.

16. The golf ball of claim 15, wherein the impregnation material has a penetration thickness that is greater than about 25 percent of the thickness of the wound thread.

17. The golf ball of claim 16, wherein the impregnation material has a penetration thickness that is greater than about 50 percent of the thickness of the wound thread.

18. The golf ball of claim 12, wherein the impregnation material penetrates substantially the entire thickness of the wound thread.

19. The golf ball of claim 12, wherein the impregnation material is selected from the group consisting of a thermoset material, a thermoplastic material, and precursors and mixtures thereof.

20. The golf ball of claim 19, wherein the impregnation material is selected from the group consisting of vinyl resins; ionic copolymers of ethylene and an unsaturated monocarboxylic acid; polyolefin homo-polymers; polyolefin co-polymers; polyurethanes; polyureas; polyamides; acrylic resins; thermoplastic rubbers; polyphenylene oxide resins; thermoplastic polyesters; solvent based latexes of polyisoprene; solvent based latexes of polybutadiene; suspension based latexes of polyisoprene; suspension based latexes of polybutadiene; reactive resins; and blends and mixtures thereof.

21. The golf ball of claim 12, wherein the impregnated wound layer further comprises at least one filler present in a sufficient amount to adjust the density of the impregnated wound layer.

22. The golf ball of claim 12, further comprising at least one intermediate layer disposed between the impregnated wound layer and the cover.

23. The golf ball of claim 22, wherein the intermediate layer is adjacent to the impregnated wound layer, comprises the at least one impregnation material, and is continuous with the at least one impregnation material in the wound layer.

* * * * *